US010808355B2

(12) United States Patent
Baldinger et al.

(10) Patent No.: US 10,808,355 B2
(45) Date of Patent: Oct. 20, 2020

(54) HIGH-STRENGTH FIBRE ROPE FOR HOISTING EQUIPMENT SUCH AS CRANES

(71) Applicant: Teufelberger Fiber Rope GmbH, Wels (AT)

(72) Inventors: Peter Baldinger, Schwertberg (AT); Robert Traxl, Ebensee (AT); Gunter Kaiser, Thalheim/Wels (AT); Rudolf Kirth, Vöclabruck (AT); Björn Ernst, Gmunden (AT); Erich Rührnössl, Haid (AT)

(73) Assignee: TEUFELBERGER FIBER ROPE GMBH, Wells (AT)

( * ) Notice: Subject to any disclaimer, the term of this patent is extended or adjusted under 35 U.S.C. 154(b) by 75 days.

(21) Appl. No.: 15/957,105

(22) Filed: Apr. 19, 2018

(65) Prior Publication Data

US 2018/0305865 A1 Oct. 25, 2018

(30) Foreign Application Priority Data

Apr. 20, 2017 (EP) ..... 17167390

(51) Int. Cl.

| | |
|---|---|
| ***D07B 1/14*** | (2006.01) |
| ***B66C 15/00*** | (2006.01) |
| ***D07B 1/02*** | (2006.01) |

(52) U.S. Cl.

CPC ..... *D07B 1/145* (2013.01); *B66C 15/00* (2013.01); *D07B 1/02* (2013.01); *D07B 1/148* (2013.01); *D07B 1/025* (2013.01); *D07B 2201/102* (2013.01); *D07B 2201/104* (2013.01); *D07B 2201/1096* (2013.01);

(Continued)

(58) Field of Classification Search

CPC ..... D07B 1/02; D07B 1/04; D07B 1/145

See application file for complete search history.

(56) References Cited

U.S. PATENT DOCUMENTS 3,949,755 A * 4/1976 Vauquois ..... D06P 1/0004 606/229

6,283,004 B1 9/2001 Tseng (Continued)

FOREIGN PATENT DOCUMENTS

DE 22 22 312 A1 11/1973

DE 24 55 273 B2 5/1976

(Continued)

*Primary Examiner* — Shaun R Hurley

(74) *Attorney, Agent, or Firm* — Workman Nydegger

(57) ABSTRACT

A high-strength fibre rope (1) comprising a rope core as well as a sheathing indicating optical wear, wherein the sheathing comprises a sheath layer (2) made up of textile subunits (3, 4) of a first hierarchy level. An outermost sheath layer (2) is provided, wherein textile subunits (3, 4) of said outermost sheath layer of the first hierarchy level differ from each other in terms of their textile structure, and/or an outermost sheath layer and a further sheath layer underneath said outermost sheath layer are provided, and wherein the textile subunits of the first hierarchy level of said outermost sheath layer differ in their textile structure from that of said further sheath layer. The textile subunits of a lowermost hierarchy level of the rope are neither dispersed in a resin matrix in the outermost sheath layer nor in the further sheath layer arranged underneath the outermost sheath layer.

21 Claims, 3 Drawing Sheets

(52) U.S. Cl.
CPC ..... *D07B 2201/2009* (2013.01); *D07B 2201/209* (2013.01); *D07B 2201/2066* (2013.01); *D07B 2201/2088* (2013.01); *D07B 2201/2092* (2013.01); *D07B 2205/201* (2013.01); *D07B 2205/205* (2013.01); *D07B 2205/2014* (2013.01); *D07B 2205/2039* (2013.01); *D07B 2205/2046* (2013.01); *D07B 2205/2096* (2013.01); *D07B 2401/2075* (2013.01); *D07B 2501/2015* (2013.01)

(56) References Cited

U.S. PATENT DOCUMENTS

| | | | | |
|---|---|---|---|---|
| 6,321,520 | B1 | 11/2001 | De Angelis | |
| 6,341,550 | B1 * | 1/2002 | White | D07B 1/147 87/5 |
| 7,127,878 | B1 | 10/2006 | Wilke et al. | |
| 7,329,271 | B2 * | 2/2008 | Koyfman | A61B 17/06166 606/228 |
| 8,012,172 | B2 * | 9/2011 | Grafton | A61B 17/06166 606/228 |
| 8,109,072 | B2 * | 2/2012 | Chou | D07B 1/025 57/237 |
| 2003/0006225 | A1 | 1/2003 | Choa | |
| 2003/0006226 | A1 | 1/2003 | Yanagimoto et al. | |
| 2003/0111298 | A1 | 6/2003 | Logan et al. | |
| 2004/0199208 | A1 * | 10/2004 | Foerster | A61B 17/06166 606/228 |
| 2005/0226584 | A1 | 10/2005 | Williams et al. | |
| 2009/0320436 | A1 | 12/2009 | Kirth et al. | |
| 2010/0274282 | A1 * | 10/2010 | Olson | A61L 17/04 606/228 |
| 2012/0297746 | A1 * | 11/2012 | Chou | D07B 1/02 57/230 |
| 2014/0157973 | A1 * | 6/2014 | Plante | D04C 1/12 87/8 |
| 2014/0178615 | A1 | 6/2014 | Broadway et al. | |
| 2014/0237983 | A1 * | 8/2014 | Love | D02G 3/48 57/238 |
| 2017/0239383 | A1 * | 8/2017 | Koyfman | A61B 17/0401 |

FOREIGN PATENT DOCUMENTS

| | | | |
|---|---|---|---|
| DE | 4035814 | | 5/1992 |
| DE | 29608971 | | 10/1996 |
| DE | 20 2009 014 031 | U1 | 1/2010 |
| DE | 20 2013 101 326 | U1 | 6/2013 |
| DE | 102015017157 | | 4/2017 |
| EP | 0 731 209 | A1 | 9/1996 |
| EP | 1 530 040 | A1 | 5/2005 |
| EP | 1 905 892 | A2 | 4/2008 |
| EP | 1 930 496 | A2 | 6/2008 |
| EP | 1 930 497 | A2 | 6/2008 |
| EP | 2 002 051 | B1 | 11/2014 |
| FR | 2410077 | | 6/1979 |
| JP | H10-318741 | A | 12/1998 |
| JP | 2001/192183 | A | 7/2001 |
| JP | 2015203169 | | 11/2015 |
| WO | 2003/054290 | A1 | 7/2003 |
| WO | 2004/029343 | A1 | 4/2004 |
| WO | 2012/162556 | A1 | 11/2012 |
| WO | 2015/139842 | A1 | 9/2015 |

* cited by examiner

HIGH-STRENGTH FIBRE ROPE FOR HOISTING EQUIPMENT SUCH AS CRANES

BACKGROUND

The present invention relates to a high-strength fibre rope for hoisting equipment such as cranes, comprising a rope core comprising high-strength synthetic fibres as well as a sheathing surrounding the rope core and indicating optical wear.

For quite some time, attempts have been made in hoisting technology and in particular with cranes to replace the conventional heavy steel ropes with high-strength fibre ropes which are made of high-strength synthetic fibres such as, e.g., aramid fibres (HMPA), aramid/carbon fibre mixtures, high modulus polyethylene fibres (HMPE), or poly (p-phenylene-2,6-benzobisoxazole) fibres (PBO) or at least comprise such fibres. Due to the weight reduction in comparison to steel ropes of up to 80%, with the breaking strength being approximately the same with a comparable diameter, the load capacity or, respectively, the permissible lifting capacity can be increased, since the dead weight of the rope to be taken into account for the load capacity is significantly smaller. Especially for cranes with high lift heights or in booms or tower shifting equipment with pulleys of a high reeving number, substantial rope lengths and hence also a corresponding rope weight are created so that the decrease in weight, which is feasible because of high-strength fibre ropes, is very advantageous. In addition to the weight advantage of the fibre rope itself, the use of fibre ropes also allows a weight reduction in further components. For example, the load hook can be of a lighter design, since a lower load hook weight is sufficient for the rope tensioning of a fibre rope in a rope drive. On the other hand, the good flexibility of synthetic fibre ropes allows smaller bending radii and hence smaller rope sheaves or, respectively, rolls on the crane, resulting in a further weight reduction especially in the area of the crane boom so that, in case of large crane outreaches, a substantial increase in load torque and an increased maximum load capacity can be achieved.

In addition to the above-mentioned weight advantages, rope drives with synthetic fibre ropes can be characterized by a substantially longer service life, easy handling and good flexibility as well as the omission of the rope lubrication as required for steel ropes. On the whole, an improved device availability can be achieved in this way.

Like steel ropes, high-strength fibre ropes are wear parts which have to be replaced when their condition has deteriorated to such an extent that the required safety is no longer provided during further operation. This condition is commonly referred to as the replacement state of wear. However, one difficulty associated with such high-strength fibre ropes consists in a precise and reliable prediction of the replacement state of wear. In conventional steel ropes, the replacement state of wear can, as such, be determined quite easily by inspecting the condition of the rope, with the course of action during the inspection and the scope of testing being specified in ISO Standard 4309. In the process, the focus is basically on the number of wire fractures across a certain measuring length of the rope, a reduction in the rope diameter as well as strand fractures. However, said measuring method is not feasible for detecting the replacement state of wear in high-strength fibre ropes, as the employed synthetic fibres do not exhibit the same behaviour as steel wire strands. In particular in high-strength fibre ropes, a sudden failure or, respectively, an onset of a replacement state of wear without any pre-existing damage that might be recognized gradually, often occurs, since, unlike in steel ropes, frequently individual fibres do not break and fan out gradually, but several fibre strands often fail simultaneously.

From document DE 20 2009 014 031 U1, a high-strength fibre rope made of synthetic fibres is known, wherein a rope core is provided with a sheathing which is coloured differently than the rope core and itself has, in turn, different sheath layers in different colours. Thanks to this multi-coloured dyeing, it should be identifiable with greater ease when a differently coloured underlying layer or even the rope core appears due to abrasion of an outer layer. However, in practice, this colour indicator function, which, per se, is reasonable, suffers from the fact that, due to the characteristics of high-strength synthetic fibres, the sheathing tends to fail altogether rather suddenly so that it is again difficult to be able to predetermine the replacement state of wear of the rope reliably and in due time.

EP 1 930 497 A and EP 1 930 496 A disclose the use of an electrically conductive indicator fibre which exhibits a lower resistance to abrasion than the load-bearing strands or fibres of the rope. If the indicator fibre is damaged or breaks, this can be determined by means of conductivity measurements. This approach is disadvantageous as it requires additional conductivity measurements and, associated therewith, the necessary technical infrastructure such as power source, conductivity meter, connection points for the indicator fibre.

From DE 20 2013 101 326 U1, the use of an electrically conductive sensor thread is known, with identical drawbacks.

Likewise, methods are known which use the elongation of the rope throughout the service life as an evaluation criterion for the condition of the rope as well as the prediction of the replacement state of wear and determine such in various ways, for example, from EP 0 731 209 A and EP 2 002 051 A. In the latter document, marks are provided on the sheath of a core/sheath rope (e.g., braided rhombi of a differently coloured material), by means of which elongations or twists of the rope can be detected.

WO 2003/054290 A1 proposes a ferromagnetic material by means of which local damage to the rope is supposed to be detectable as well.

WO 2012/162556 discloses a rope with one or optionally several sheath layers, wherein at least in one sheath layer the fibres, which form the fibre strands, are present dispersed in a resin matrix in the form of fibre bundles and therefore as plied, untwisted yarn. A resin matrix changes the properties of the fibres and protects them against wear. For indicating the replacement state of wear of the rope also in WO 2012/162556 indicator fibres which can forward electrical or optical signals, are proposed.

Further prior art is known from US 2003/111298, JP 2001/192183, WO 2004/029343, US 2005/226584, EP 1 905 892, WO 2015/139842, EP 1 530 040, US 2003/06225, US 2003/06226, JP H10 318741, DE 22 22 312 A and U.S. Pat. No. 6,321,520 B1.

The use of fibres with varying elongation behaviours within one rope is described in DE 24 55 273 B2 and is supposed to serve the purpose that all strand layers of the rope will assume load, but not the purpose of indicating wear.

In U.S. Pat. No. 7,127,878 B1, a rope is described which is manufactured from at least two materials of different tensile strengths, wherein the first material assumes the tensile load during normal operation. In case the rope is subjected to tensile overloading, material 2 takes over the tensile load from material 1, thus preventing a total failure of the rope. However, the detection of a replacement state of wear caused by abrasion, in particular in rope drives in which the rope is bent over sheaves, remains unaffected thereby.

BRIEF SUMMARY

In contrast, the present invention is based on the object of providing an improved high-strength fibre rope which avoids the disadvantages of the prior art and develops further the latter in an advantageous manner. In particular, a simple, but nonetheless reliable and precise determination of the replacement state of wear and hence a period of use as long as possible should be rendered possible, without thereby compromising the safety of the fibre rope.

According to the invention, the above-mentioned object is achieved by a high-strength fibre rope.

The sheathing of the high-strength fibre rope according to the invention comprises at least one braided sheath layer made up of at least two textile subunits of a first hierarchy level, which are braided with each other, wherein optionally part of the textile subunits of the first hierarchy level comprise at least two textile subunits of a second hierarchy level, which, in turn, optionally comprise at least two textile subunits of a third hierarchy level.

For the sake of clarity, in the following, the subunits of the first hierarchy level are abbreviated with 1TUE, the subunits of the second hierarchy level are abbreviated with 2TUE, and the subunits of the third hierarchy level are abbreviated with 3TUE.

The at least two 1TUEs may be provided, for example, in the form of strands, small ropes, twines, cords, ribbons and/or yarns, which are braided with each other. Depending on the configuration of the 1TUEs, those may be formed, in turn, from at least two, preferably several, 2TUEs which are twisted, braided, machine-knit, knitted, woven and/or arranged essentially in parallel. For example, a 1TUE provided in the form of a strand or small rope may thus itself be formed from several twines, cords, ribbons and/or yarns.

Correspondingly, depending on the configuration of the 2TUEs, those may, in turn, be formed from at least two, preferably several, 3TUEs which are twisted, braided, machine-knit, knitted, woven and/or arranged essentially in parallel. For example, a 2TUE provided in the form of a small rope, a twine, a cord or a ribbon may thus itself be formed from several yarns, which then constitute the 3TUE.

For the purposes of the present invention fibre bundles, which are used for forming the textile subunits, in particular plied, i.e., untwisted yarns, are defined as the lowermost hierarchy level of the rope according to the invention.

The sheathing of the high-strength fibre rope according to the invention may be formed either only by an outermost layer or may be formed by an outermost layer and a further sheath layer arranged underneath the outermost layer. The further sheath is thereby arranged between the rope core and the outermost sheath layer, wherein the further sheath layer may enclose the rope core entirely or only partially.

In a sheathing with an outermost sheath layer and a further sheath layer arranged underneath the outermost sheath layer, the further sheath layer may be arranged either directly underneath the outermost sheath layer or may be arranged underneath the outermost sheath layer while being separated from said layer by one or several particularly fast-wearing separating layer(s). A separating layer may, for example, be a thin film made of a synthetic material.

The textile subunits of a lowermost hierarchy level of the rope are neither dispersed in a resin matrix in the outermost sheath layer nor dispersed in a resin matrix in the further sheath layer arranged underneath the outermost sheath layer, as is provided in WO 2012/162556.

Preferably, all the textile subunits of the rope essentially consist of textile fiber material. This means that none of the textile subunits of the rope are dispersed in a resin matrix. This is not meant to exclude the optional presence of an impregnation only on the surface of subunits (see below).

The 1TUE and/or, if provided, the 2TUE of the outermost layer differ from each other in terms of their textile structure and, resulting therefrom, exhibit different wear resistances.

The "textile structure" of the 1TUE and/or, if provided, of the 2TUE is generally understood to be the textile arrangement and the construction of the subunits or, respectively, of the subunits on which they are based. For the purposes of the present invention, the term "textile structure" does not encompass the properties of the materials used for constructing the rope, i.e., of the synthetic fibres, namely, for example, their chemical nature, fineness (thickness), abrasion and/or tensile strength and/or bending fatigue.

However, apart from the concrete construction of the subunits, textile parameters of the subunits such as, e.g., the presence of an impregnation or a reinforcement also fall under "textile structure".

The varying textile structure of the textile subunits as provided according to the invention results in different wear resistances of the subunits, irrespective of the properties of the fibre material used in each respective case. Thus, textile subunits of different structures are subject to wear differently even if they are impacted uniformly by wear-promoting influences. The result is a diverse change in the sheathing under strain, which is detectable optically. According to the invention, the wear resistance of the sheathing of the core/sheath rope is thus changed primarily by the change in the textile structure of the 1TUE and/or, if provided, of the 2TUE, rather than by the properties of the material used for the employed synthetic fibres.

Advantageously, the 1TUE and/or, if provided, the 2TUE differ from each other in terms of their structure in at least one of the following properties:

mode of construction:

As possible modes for the construction of subunits, twisting, braiding, machine-knitting, knitting, weaving or guiding the subunits of a subordinate hierarchy level forming the respective subunit side by side in parallel may be mentioned. For example, a 1TUE may thus be constructed by at least two, in particular several, 2TUEs which are braided with each other, twisted, machine-knit, knitted, woven and/or guided side by side in parallel. A second 1TUE may have a different construction than the first 1TUE, i.e., the 2TUEs are provided in the second 1TUE in a differently constructed state than in the first 1TUE. This applies analogously to one hierarchy level below, i.e., to 2TUEs which may be constructed differently from the respective 3TUEs.

technical parameters of the construction:

With a given construction (e.g., braiding or twisting), "technical parameters of the construction" are, in particular, understood as parameters influencing the wear resistance of said construction. A technical parameter for a twisted textile subunit is, for example, the lay angle. Technical parameters for a braided textile subunit are, for example, the braid angle or the number of braiding. The number of braiding is understood to be the number of bobbins from which strands or twines are supplied in the braiding machine.

if provided, number of 2TUEs per 1TUE:

For example, a textile subunit may be more wear resistant with an otherwise equal construction and the same material, if a higher number of 2TUEs per 1TUE is provided. Accordingly, a 1TUE formed by a strand may, for example, have a higher wear resistance if the strand has a higher number of 2TUEs formed, e.g., by twines than another 1TUE.

if provided, number of 3TUEs per 2TUE; and presence and/or type and/or extent of impregnation in one or several subunits: Due to the impregnation, a surface hardness of the textile subunits and/or the surface roughness thereof can be modified. Thus, via the impregnation, the wear resistance of textile subunits may, for example, be increased or reduced as needed. As known, impregnations may comprise materials from the group consisting of polyurethanes, waxes, silicones and mixtures thereof. For the purposes of the present invention, "impregnation" is understood to mean application of impregnating material to the respective textile subunit only on the surface. Complete dispersion of textile subunits, in particular of textile subunits of the lowermost hierarchy level, in a resin matrix does not constitute an impregnation in the sense of the present invention.

All of the above-mentioned possibilities of different textile structures may, of course, be combined with each other.

Examples of the varying construction of textile subunits of different hierarchy levels:

One part of 1TUE is twisted, and another part of 1TUE is braided.

1TUEs are, in each case, twisted, wherein the extent of twisting in one part of the 1TUEs is larger than the extent of twisting in another part of the 1TUEs. In this connection, the difference in twists per metre may preferably amount to at least 40 T/m (that is, for example, one part of subunits with 20 T/m and another part of subunits with 60 T/m or more).

In the above embodiments, different structures are provided on the first hierarchy level of the rope, namely, in concrete terms, in the mode of the construction of the 1TUEs themselves and, respectively, of parameters for the construction of the 1TUEs (e.g., extent of twisting).

In the following embodiments, the differences in the structure are provided on the second hierarchy level of the rope, that is, in 2TUE:

1TUEs are, in each case, twisted, wherein the extent of twisting of the 2TUEs used for forming the 1TUEs is larger in one part of the 1TUEs than the extent of twisting of the 2TUEs in another part of the 1TUEs. Again, the difference in twists per metre may preferably amount to at least 40 T/m.

1TUEs are formed from a plurality of 2TUEs arranged next to each other essentially in parallel, wherein the 2TUEs are braided in one part of the 1TUEs and the 2TUEs are twisted in another part of the 1TUEs.

As an alternative or in addition, in the 1TUEs, one part of the 2TUEs arranged next to each other in parallel can be twisted, and another part can be braided, wherein the respective number of twisted and braided 2TUEs or the extent of twisting or the braid angle of the 2TUEs in one part of the 1TUEs differs from another part of the 1TUEs.

1TUEs are formed from a plurality of 2TUEs arranged next to each other essentially in parallel, wherein the 2TUEs are twisted and wherein the 2TUEs are twisted more strongly in one part of the 1TUEs than in another part of the 1TUEs.

Once again, all the above-indicated possibilities can also be combined with each other.

A further difference may consist in the presence or, respectively, in the type and extent of an impregnation or also a reinforcement in part of the 1TUEs or 2TUEs.

A textile structure of the textile subunits is advantageously chosen such that, based on the abrasion arising throughout the period of use of the high-strength fibre rope or, respectively, the wear arising throughout the period of use of the high-strength fibre rope and an optical change in the sheathing resulting therefrom, a reliable statement can be given on whether the high-strength fibre rope has reached its replacement state of wear. In most cases, damage to the outermost sheath layer thereby occurs essentially only partially and gradually so that, based on the gradually increasing damage spots, different states of wear of the high-strength fibre rope and, associated therewith, the remaining interval to the replacement state of wear are determinable and quantifiable on a gradual basis.

The determination of the replacement state of wear may be conducted by a qualified person as a visual inspection by means of reference illustrations of the rope at different degrees of damage or based on a pool of experience and is thus determinable in a macroscopic way. Advantageously, the qualified person categorizes the damages which have occurred, documents them in written form and adds them up in order to then determine the replacement state of wear, if applicable. Likewise, the possibility exists that the determination of the replacement state of wear is effected by means of a software, for which the sheathing is optically detected using camera systems.

Preferably, the textile structure of the 1TUEs and/or, if provided, of the 2TUEs is adjusted and determined individually for each rope. This is advantageous in that, for each rope, a reliable indicator is created which has been adjusted individually to the intended purpose, the application site and the type of strain and allows a quick and straightforward determination as to whether the rope has reached its replacement state of wear.

With a sheathing of the high-strength fibre rope according to the invention comprising an outermost layer and a further sheath layer arranged underneath the outermost layer, advantageously, not only the 1TUEs and/or, if provided, the 2TUEs differ from each other with regard to their textile structure in the individual layers, but the 1TUEs and/or, if provided, the 2TUEs of the outermost sheath layer may also differ in their textile structure from that of the further sheath layer.

For example, the possibility exists that each sheath layer exhibits a characteristic stability against abrasion and wear due to the different textile structures of the textile subunits, which stability leads to a partly different damage pattern in each sheath layer and, respectively, causes the sheath layers to wear out at different rates. For example, optically visible wear at the outermost sheath layer may thus indicate that the replacement state of wear will soon be reached, whereas the actual replacement state of wear of the rope is reached only in case of optically visible wear at the further sheath layer. In this way, enough time is left, for example, for making provisions that a new rope is ordered or provided. Up until the delivery, the rope may still be used further, whereby a reliable indicator as to whether the rope is still usable or not is created nonetheless by the further sheath layer.

In other words, solely by changing the textile structure of the textile subunits of the sheathing, the wear resistance of the sheathing of the high-strength fibre rope according to the invention can be changed and adapted to a service life of the high-strength fibre rope in such a way that, by visually assessing the sheathing, the point of time when the high-strength fibre rope has reached its replacement state of wear can be determined reliably.

In addition, various synthetic fibres may be used in the textile subunits for changing the wear resistance of the sheathing, and thus the differences between the wear resistances of the textile subunits can be enhanced.

The synthetic fibres forming the basis of the sheathing of the high-strength fibre rope according to the invention may, for example, be HMPE fibres, polyester fibres, polyamide fibres, PBO fibres and/or mixed fibres from aramid and carbon fibres.

Furthermore, if a further sheath layer is present in the sheathing, synthetic fibres may additionally be provided in the outermost sheath layer, which synthetic fibres differ in terms of their fineness and/or abrasion and/or tensile strength and/or their bending fatigue and/or their materials at least from part, in particular from all of the synthetic fibres of the further sheath layer. In this case, the extent of the different wear resistances resulting from the different structures of the textile subunits as provided according to the invention is enhanced even further by varying material properties.

In a high-strength fibre rope according to the invention comprising a sheathing which comprises the further sheath layer, the sheathing advantageously has sheath layers of different layer thicknesses and/or synthetic fibres with different thicknesses from layer to layer. By using synthetic fibres of different thicknesses, damage patterns which are different from layer to layer can, for example, be obtained, even if the textile structure is equal or similar. Also by using differently dimensioned layer thicknesses, which, for example, may increase from the outside to the inside, it can be ensured that the occurrence of damages penetrating deeper and deeper becomes increasingly difficult and, at first, only minor damages, which are still relatively far remote from the replacement state of wear, appear first at the outer layer and are therefore readily detectable.

In order to render the various damages readily detectable also in case of only a small extent of damage, the textile subunits of different hierarchy levels, which exhibit different wear resistances, can be dyed with different colours. The possibility also exists that synthetic fibres from which the textile subunits of the lowermost hierarchy level are formed are dyed with different colours.

In a high-strength fibre rope according to the invention with a sheathing comprising an outermost sheath layer and a further sheath layer arranged underneath the former, the sheath layers can be dyed with different colours. In this way, an optical detection of damages to the sheathing due to wear is substantially facilitated, since, if the outermost sheath layer wears out, the further sheath layer arranged underneath becomes visible in a different colour or colour combination.

Specifically, the rope core may also have a different colour than the sheathing, in particular a different colour than the further sheath layer or, respectively, the outermost sheath layer of the sheathing, so that at the latest with a complete wear of the sheathing, the different colour of the rope core becomes visible.

It is also conceivable that the sheathing of the high-strength fibre rope according to the invention comprises additional further sheath layers which are arranged on top of each other between the rope core and the external sheath layer, thereby covering each other at least partly.

Furthermore, the possibility exists that, in the high-strength fibre rope according to the invention, the sheathing is impregnated at least partly, a reinforcement surrounding the outermost sheath layer is formed at least partly around the sheathing and/or a thin film surrounding the outermost sheath layer is formed at least partly around the sheathing.

A high-strength fibre rope according to the invention as described according to the above explanation is advantageously used as part of a hoisting equipment, in particular in cranes such as tower slewing cranes, telescopic cranes, dockside or ship cranes. Preferably, it is configured as a crane hoisting rope or as a crane boom suspension rope.

Preferably, the sheathing of the rope is designed so as to be non-load bearing.

BRIEF DESCRIPTION OF THE DRAWINGS

The invention is illustrated below in further detail on the basis of preferred exemplary embodiments and associated drawings. In the drawings.

DETAILED DESCRIPTION

FIGS. 1 to 7 each show a detail of a design variant of a high-strength fibre rope according to the invention. Each of the high-strength fibre ropes is formed from a rope core, which is not visible in FIGS. 1 to 7, and a sheathing surrounding the rope core, wherein the sheathing is formed directly around said rope core or, optionally, can be spaced apart therefrom by an interlayer. The rope core can assume the entire indicated tensile strength of the fibre rope. In particular, said sheathing may form the outer sheath of the fibre rope and acts especially only as a support and as a protection for the rope core. The sheathing comprises an outermost sheath layer which is formed from braided 1TUEs, whereby a rhombus-shaped braiding pattern is formed. The 1TUEs and/or, if provided, the 2TUEs differ from each other in their textile structures, resulting in wear resistances of the subunits which are different in each case, from which the state of wear of the rope can be detected optically.

In none of the illustrated embodiments, a resin matrix is provided in one of the sheath layers, in which resin matrix the TUEs of the lowermost hierarchy level are dispersed.

Figure 1:
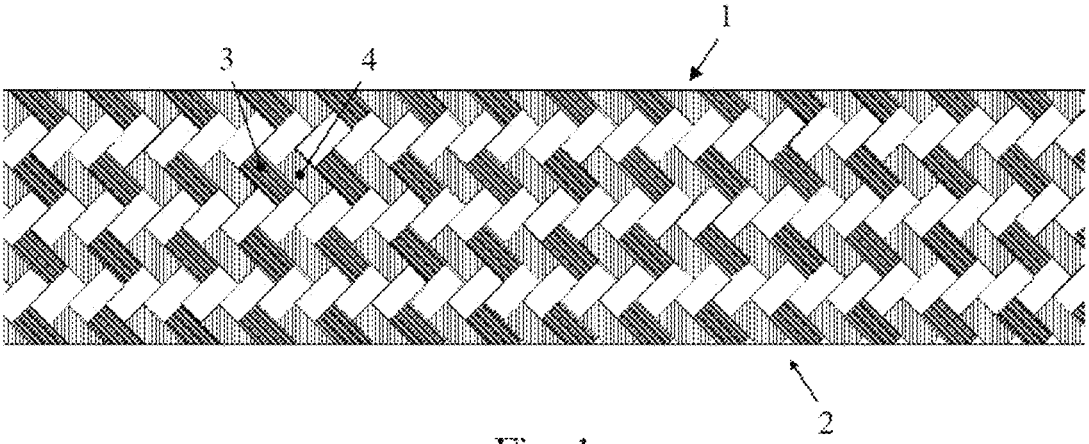
FIG. 1 to FIG. 7: each show a detail of a sheathing of a design variant of a high-strength fibre rope according to the invention. Therein, the 1TUEs each are illustrated in only one braiding direction (herein S) for the sake of better readability. All explanations analogously refer to the second braiding direction (herein Z).

Specifically:

FIG. 1 shows a design variant of a high-strength fibre rope 1 according to the invention. The outermost sheath layer 2 is formed by two 1TUEs braided with each other, which are provided in the form of small ropes 3, 4 twisted from twines (not illustrated). The small ropes 3,4 thus form the 1TUEs of the rope, the twines used for twisting the small ropes form the 2TUEs of the rope.

The small rope 3 has a twist X, and the small rope 4 has a twist Y different therefrom.

Advantageously, the twist X of the small rope 3 may amount to 20 T/m, and the twist Y of the small rope 4 may amount to 60 T/m or more.

A different structure (herein: extent of twisting) is thus provided on the level of the 1TUE.

The synthetic fibres of the twines forming the basis of the small rope 3 may either exhibit the same material as the synthetic fibres of the twines forming the basis of the small rope 4, or they may be formed from a different material.

Thus, the synthetic fibres used in the small rope 3 can, for example, be formed from polyester fibres, and the synthetic fibres used in the small rope 4 can be formed from HMPE fibres.

Furthermore, as an alternative or in addition to said embodiment, the possibility exists that the twines forming the small ropes 3 are provided with an impregnation, whereas the twines forming the small ropes 4 are not.

As an alternative or in addition, there is the further possibility that the number of twines forming the small ropes 3 is different from that of the twines forming the small ropes 4.

Figure 2:
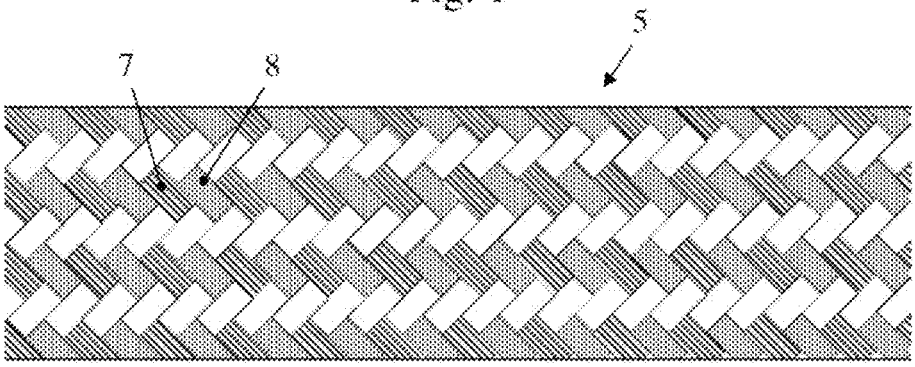

FIG. 2 shows a further design variant of a high-strength core/sheath rope 5 according to the invention.

The 1TUEs are provided in the form of strands 7 and 8.

The strands 7 and 8 are each formed from several 2TUEs arranged next to each other essentially in parallel. The 2TUEs of the strands 7 and 8 are formed from twisted twines, which are not illustrated further in FIG. 2, and exhibit a twist X in the strand 7 and a twist Y different from X in the strand 8.

Advantageously, the twist X may amount to 20 T/m, and the twist Y may amount to 60 T/m or more.

Thus, a varying structure (herein: extent of twisting) is provided on the level of the 2TUE. Of course, this feature might be provided in addition also in the embodiment according to FIG. 1.

Furthermore, as an alternative or in addition to said embodiment, the possibility exists that the number of twines forming the strands 7 is different from the number of twines forming the strands 8.

Figure 3:
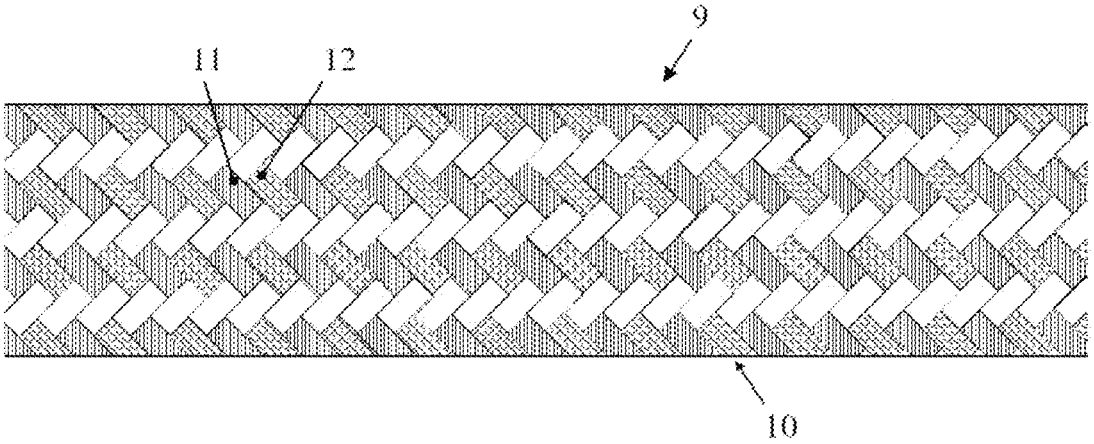

FIG. 3 shows a further design variant of a high-strength fibre rope 9 according to the invention. The outermost sheath layer 10 is formed by two 1TUEs braided with each other in the form of small ropes 11 and small ropes 12.

The small rope 11 is twisted from several twines (2TUE).

The small rope 12 is braided from several twines (2TUE).

Thus, the small ropes 11 and the small ropes 12 exhibit a different construction.

Again, the synthetic fibres used in the small rope 11 may either exhibit the same material as the synthetic fibres used in the small rope 12, or the material of the synthetic fibres may be different. Thus, the synthetic fibres used in the small rope 11 can, for example, be formed from PBO fibres, and the synthetic fibres used in the small rope 12 can be formed from aramid fibres.

Figure 4:
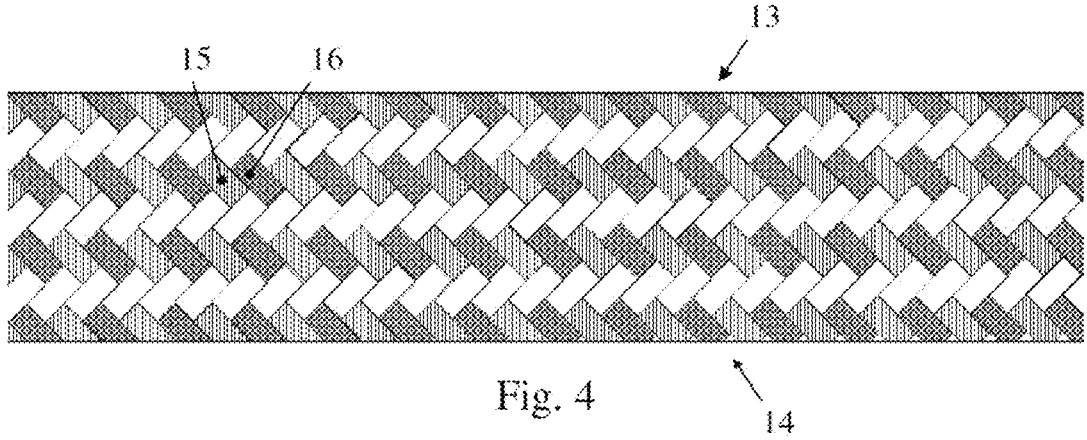

FIG. 4 shows a further design variant of a high-strength fibre rope 13 according to the invention. The outermost sheath layer 14 is formed by two 1TUEs 15 and 16 braided with each other, which are provided in the form of strands 15 and 16. The strands 15 and 16 are each formed from several 2TUEs arranged next to each other essentially in parallel.

The 2TUEs of the strands 15 are twisted with each other with a twist X.

The 2TUEs of the strands 16 are braided with each other.

As an alternative, one part of the 2TUEs arranged next to each other essentially in parallel in 1TUEs 15 and 16 may be twisted, and another part of the 2TUEs may be provided in a braided state, wherein the respective number of twisted and braided 2TUEs or also the extent of twisting or the braid angle of the 2TUEs in one part of the 1TUEs differs from another part of the 1TUEs. For example, 3 braided and 2 twisted 2TUEs might be provided next to each other essentially in parallel in the 1TUEs 15, and 2 braided and 3 twisted 2TUEs might be provided next to each other essentially in parallel in the 1TUEs 16.

In addition or as an alternative, the possibility exists that the 2TUEs are each formed from a different number of 3TUEs.

Figure 5:
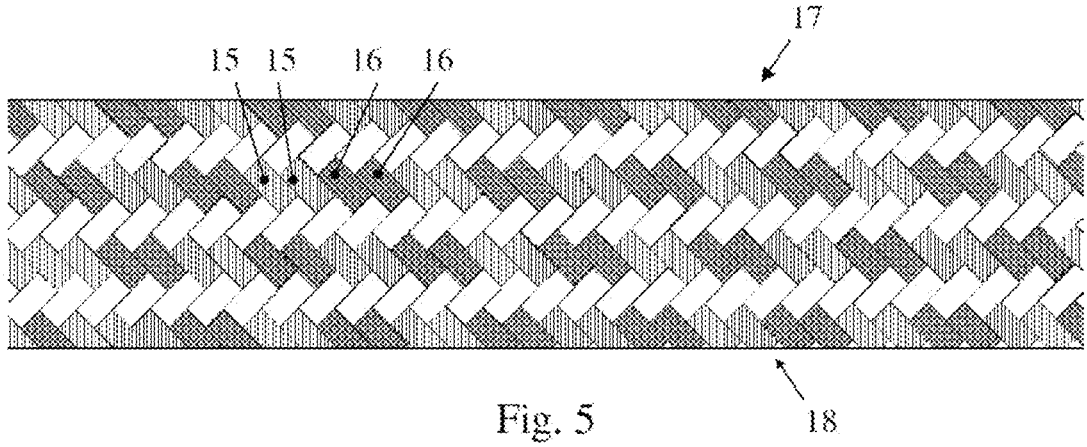

FIG. 5 shows a further design variant of a high-strength fibre rope 17 according to the invention. The outermost sheath layer 18 differs from the outermost sheath layer 14 of the high-strength fibre rope 13 illustrated in FIG. 4 in that the bobbin sequence of the 1TUEs is different.

In FIGS. 1 to 5, two subunits having different structures are respectively illustrated. The result is a two-stage progression of wear of the outermost sheath layer, which is detectable optically.

Figure 6:
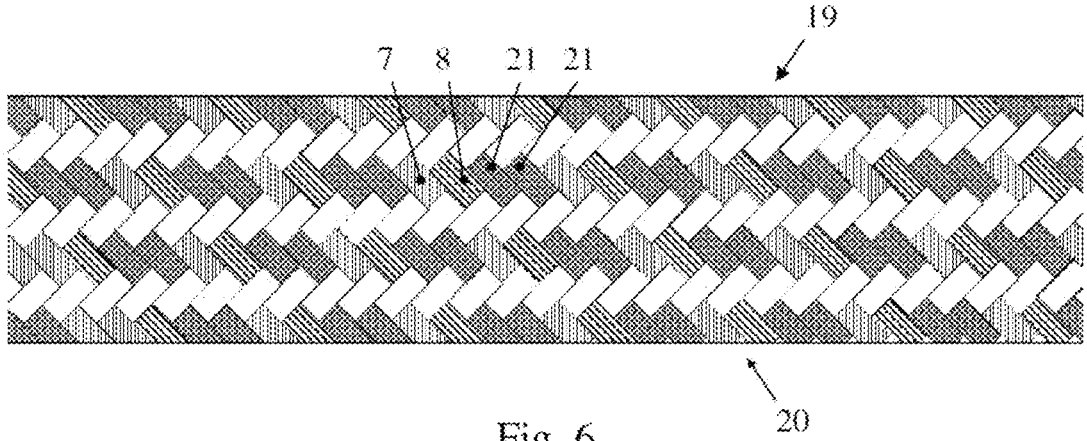

FIG. 6 shows a further design variant of a high-strength fibre rope 19 according to the invention. The high-strength fibre rope 19 differs from the high-strength fibre rope 2 shown in FIG. 2 in that the high-strength fibre rope 19 exhibits a further 1TUE in the form of a strand 21 in its outermost sheath layer 20.

The strand 21 is formed from several 2TUEs arranged next to each other essentially in parallel, which are braided with each other.

Thus, the rope according to this embodiment comprises two strands 7 and 8 the 2TUEs of which are twisted with different strengths and a further strand 21 the 2TUEs of which are braided with each other. This results in wear of the outermost sheath layer 20 which progresses in three stages and is detectable optically.

The synthetic fibres used in the strand 21 may exhibit the same material as the synthetic fibres in the strands 7 and 8, or they may be made of a different material.

Figure 7:
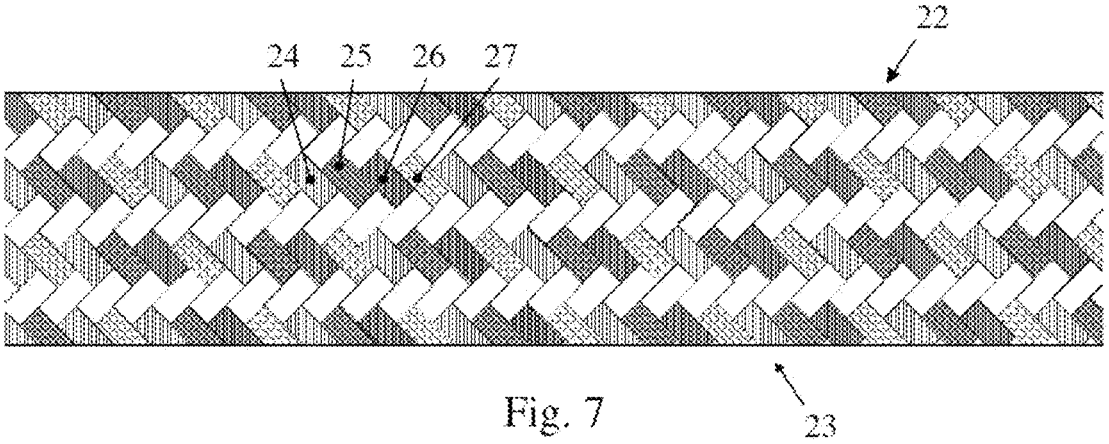

FIG. 7 shows a further design variant of a high-strength fibre rope 22 according to the invention. The outermost sheath layer 23 is formed by four 1TUEs braided with each other. The 1TUEs are formed by strands 24, 25, 26 and 27.

The strands 24, 25, 26 and 27 each have several 2TUEs arranged next to each other essentially in parallel. In each case, the 2TUEs are formed from twines consisting of several 3TUEs. The 3TUEs are formed from yarns. The twines of the strand 24 are twisted with a twist X, the twines of the strand 25 are braided at a braid angle A, the twines of the strand 26 are twisted with a twist Y different from X, and the twines of the strand 27 are braided at a braid angle B different from A.

Thereby, a four-stage progression of wear of the sheath is created, which is detectable optically.

In this connection, it should be noted that implementations of the design variants as shown in FIGS. 1 to 7 can be combined with each other in any desired way, whereby further design variants can be developed.

Furthermore, it should also be pointed out that the sheathing of the design variants of the high-strength fibre rope according to the invention as described in FIGS. 1 to 7 may have a further sheath layer arranged underneath the outermost sheath layer, which further sheath layer may be configured according to one of the described outermost sheath layers or may exhibit a different number of 1TUEs and/or optionally 2TUEs and/or optionally 3TUEs with different textile structures.

Furthermore, it should be noted that the synthetic fibres in the sheath layers may differ with regard to their thicknesses and/or the sheath layers may differ with regard to their thicknesses.

The invention claimed is:

1. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein one of the at least two textile subunits of the first hierarchy level is braided and another one of the at least two textile subunits of the first hierarchy level is twisted, wherein the sheathing includes an outermost sheath layer, the outermost sheath layer including textile subunits of the first hierarchy level, wherein the textile subunits of the first hierarchy level of the outermost sheath layer differ from each other in terms of their textile structure and, resulting therefrom, exhibit different wear resistances, and wherein textile subunits of a lowermost hierarchy level of the rope are not dispersed in a resin matrix in the outermost sheath layer.

2. A high-strength fibre rope according to claim 1, wherein the textile subunits of the first hierarchy level differ from each other in terms of their textile structure in at least one of the following properties:

mode of the construction;

technical parameters of the construction, including braid angle or lay angle; and one or more of presence, type, or extent of impregnation.

3. A high-strength fibre rope according to claim 1, wherein at least two textile subunits of the first hierarchy level are twisted, wherein one of the at least two textile subunits of the first hierarchy level is twisted more strongly than another one of the at least two twisted textile subunits of the first hierarchy level.

4. A high-strength fibre rope according to claim 1, wherein textile subunits which exhibit different wear resistances are dyed with different colours.

5. A high-strength fibre rope according to claim 1, wherein the rope core has a colour deviating from that of the sheathing.

6. A hoisting equipment comprising a high-strength fibre rope configured according to claim 1.

7. The hoisting equipment according to claim 6, wherein the high-strength fibre rope forms a crane hoisting rope or a crane boom suspension rope.

8. A high-strength fibre rope according to claim 1, wherein at least one of the textile subunits of the first hierarchy level comprises at least two textile subunits of a second hierarchy level.

9. A high-strength fibre rope according to claim 8, wherein the textile subunits of the first hierarchy level differ from each other according to number of textile subunits of the second hierarchy level in each textile subunit of the first hierarchy level.

10. A high-strength fibre rope according to claim 8, wherein at least one of the textile subunits of the second hierarchy level comprises at least two textile subunits of a third hierarchy level.

11. A high-strength fibre rope according to claim 10, wherein the textile subunits of the first hierarchy level differ from each other according to number of textile subunits of the third hierarchy level per textile subunit of the second hierarchy level.

12. A high-strength fibre rope according to claim 8, wherein the textile subunits of the second hierarchy level differ from each other in terms of their textile structure.

13. A high-strength fibre rope according to claim 1, further comprising a further sheath layer arranged underneath the outermost sheath layer, and wherein the textile subunits of the first hierarchy level of the outermost sheath layer differ in textile structure from that of the further sheath layer, and thereby exhibit different wear resistances, and wherein the textile subunits of a lowermost hierarchy level of the rope are not dispersed in a resin matrix in the further sheath layer arranged underneath the outermost sheath layer.

14. A high-strength fibre rope according to claim 13, wherein synthetic fibres of the outermost sheath layer differ from at least part of synthetic fibres of the further sheath layer according to one or more of fineness, abrasion, tensile strength, bending fatigue, or materials.

15. A high-strength fibre rope according to claim 13, wherein the sheathing comprises sheath layers having layers of different thicknesses, synthetic fibres with different thicknesses from layer to layer, or both.

16. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein the sheathing comprises an outermost sheath layer and a further sheath layer arranged underneath the outermost sheath layer, wherein textile subunits of the first hierarchy level of the outermost sheath layer differ in textile structure from that of the further sheath layer, and thereby exhibit different wear resistances, and wherein textile subunits of a lowermost hierarchy level of the rope are not dispersed in a resin matrix in the outermost sheath layer and are not dispersed in a resin matrix in the further sheath layer arranged underneath the outermost sheath layer.

17. A high-strength fibre rope according to claim 16, wherein at least one of the textile subunits of the first hierarchy level comprises at least two textile subunits of a second hierarchy level, and wherein the textile subunits of the second hierarchy level of the outermost sheath layer differ in textile structure from that of the further sheath layer.

18. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein at least one of the textile subunits of the first hierarchy level comprises at least two textile subunits of a second hierarchy level, wherein the sheathing includes an outermost sheath layer, the outermost sheath layer including textile subunits of the first hierarchy level, wherein the textile subunits of the second hierarchy level of the outermost sheath layer differ from each other in terms of their textile structure and, resulting therefrom, exhibit different wear resistances, and wherein textile subunits of a lowermost hierarchy level of the rope are not dispersed in a resin matrix in the outermost sheath layer.

19. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein at least one of the textile subunits of the first hierarchy level comprises at least two textile subunits of a second hierarchy level, wherein the sheathing comprises an outermost sheath layer and a further sheath layer arranged underneath the outermost sheath layer, wherein textile subunits of the second hierarchy level of the outermost sheath layer differ in textile structure from that of the further sheath layer, and thereby exhibit different wear resistances, and wherein textile subunits of a lowermost hierarchy level of the rope are not dispersed in a resin matrix in the outermost sheath layer and are not dispersed in a resin matrix in the further sheath layer arranged underneath the outermost sheath layer.

20. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein at least two textile subunits of the first hierarchy level are twisted, wherein one of the at least two textile subunits of the first hierarchy level is twisted more strongly than another one of the at least two twisted textile subunits of the first hierarchy level, wherein the sheathing includes an outermost sheath layer, the outermost sheath layer including textile subunits of the first hierarchy level, wherein the textile subunits of the first hierarchy level of the outermost sheath layer differ from each other in terms of their textile structure and, resulting therefrom, exhibit different wear resistances, and wherein textile subunits of a lowermost hierarchy level of the rope are not dispersed in a resin matrix in the outermost sheath layer.

21. A high-strength fibre rope for hoisting equipment, comprising:

a rope core comprising high-strength synthetic fibres or strands; and a sheathing surrounding the rope core and optically indicating wear, wherein the sheathing comprises at least one sheath layer made up of at least two textile subunits of a first hierarchy level, which are braided with each other, wherein at least one of the textile subunits of the first hierarchy level comprises at least two textile subunits of a second hierarchy level, wherein the sheathing includes an outermost sheath layer, the outermost sheath layer including textile subunits of the first hierarchy level, wherein the textile subunits of the first hierarchy level of the outermost sheath layer differ from each other in terms of their textile structure and, resulting therefrom, exhibit different wear resistances, and wherein textile subunits of a lowermost hierarchy level of the rope are not dispersed in a resin matrix in the outermost sheath layer.

* * * * *